US005497982A

United States Patent [19]

Stoltz et al.

[11] Patent Number: 5,497,982

[45] Date of Patent: Mar. 12, 1996

[54] UNIVERSAL SKI HOLDING DEVICE

[76] Inventors: James V. Stoltz, 3333 NE. 34th St., 115, Ft. Lauderdale, Fla. 33308; Tony J. Zeeb, 19790 W. Dixie Hwy., Miami, Fla. 33180

[21] Appl. No.: 389,509

[22] Filed: Feb. 16, 1995

[51] Int. Cl.[6] ..... B23Q 1/04

[52] U.S. Cl. ..... 269/71; 269/242; 269/270; 269/906

[58] Field of Search ..... 269/71, 242, 296, 269/43, 88, 406, 268, 270

[56] References Cited

U.S. PATENT DOCUMENTS

| | | | |
|---|---|---|---|
| 4,050,685 | 9/1977 | Cox | 269/906 |
| 4,081,180 | 3/1978 | Munn | 269/906 |
| 4,175,736 | 11/1979 | Dietlien | 269/906 |
| 5,236,183 | 8/1993 | Curtis | 269/906 |

*Primary Examiner*—Robert C. Watson

[57] ABSTRACT

A universal ski holding device positively and fixedly mounts a ski, via its binding's heel piece and toe piece, in its inverted position with its major bottom surface uppermost for maintenance and tuning. Two mounting supports support an elongated bed having a way with which heel-carriage and toe-carriage pieces are complementally engaged. A nut carried by the toe-carriage piece is operatively engaged by an elongated screw to move the toe-carriage piece longitudinally relative to the heel-carriage piece to constitute a boot portion simulating a ski boot and thereby effect mounting via the ski's binding. Adjustably pivotable spatial accommodating elements mounted by the heel-carriage and toe-carriage pieces further spatially accommodate the vertical-height differences in the various heel and toe pieces of conventional bindings. The mounting supports provide uppermost mounting of either lateral edge of the ski for maintenance and tuning by simply rotating 90 degrees from the vertical position in one direction or the other.

7 Claims, 5 Drawing Sheets

UNIVERSAL SKI HOLDING DEVICE

BACKGROUND OF THE INVENTION

1. Technical Field

This invention relates to a universal ski holding device for fixedly and positively mounting a conventional snow ski via its binding.

2. Background

The problem in the art to which this invention apertains is the need for a universal ski holding device for fixedly and positively mounting a ski via its binding to allow inverted disposition of the ski's major bottom surface or base uppermost for maintenance and "tuning", for disposition of a lateral edge of the ski uppermost for maintenance and tuning by rotation 90 degrees in one direction, and for disposition of the opposite lateral edge of the ski uppermost for maintenance and tuning by rotation 90 degrees in the opposite direction.

SUMMARY OF THE INVENTION

Accordingly, the object of the invention is to contribute to the solution of the discussed problem in the art by providing a universal ski holding device that has a fixed heel-carriage piece and a toe-carriage piece complementally engaging a longitudinal way of an elongated bed of the device and is movable longitudinally toward or away from the fixed heel-carriage piece via an elongated screw operatively engaged with a nut fixedly embedded in the toe-carriage piece; and the heel-carriage and toe-carriage pieces constituting a boot portion simulating a ski boot, and with the heel-carriage and toe-carriage pieces being fixedly and positively received within the binding of the ski in its inverted position.

The screw can be appropriately rotated to move the toe-carriage piece in an appropriate longitudinal direction relative to the fixed heel-carriage piece to spatially accommodate different sizes of ski boots and their corresponding bindings. Pivotable spatial accommodating elements, carried by the heel-carriage and toe-carriage pieces, are adjustable to spatially accommodate the physical vertical-height differences that present themselves in the various heel and toe pieces of conventional ski bindings. The structural features of the relative longitudinal disposition of the heel-carriage and toe-carriage pieces, together with the concomitantly adjustable pivotable spatial accommodating elements, and their concomitant universal functional attributes, provide for positive and fixed mounting of the ski via its binding. The mounting support for the device's elongated bed allows maintenance and tuning of the ski's major bottom surface or base by disposition of the ski's base uppermost; allows for maintenance and tuning of a lateral edge of the ski by simple rotation 90 degrees in one direction for disposition of that ski's lateral edge uppermost; and allows for maintenance and tuning of the ski's opposite lateral edge by simple rotation 90 degrees in the opposite direction for disposition of that ski's opposite lateral edge uppermost.

BRIEF DESCRIPTION OF THE DRAWINGS

This object of the invention and other objects of the invention should be discerned and appreciated by reference to the DETAILED DESCRIPTION OF THE PREFERRED EMBODIMENT taken in conjunction with the drawings, wherein like reference numerals refer to similar parts throughout the several views, in which.

DETAILED DESCRIPTION OF THE PREFERRED EMBODIMENT

Figure 1:
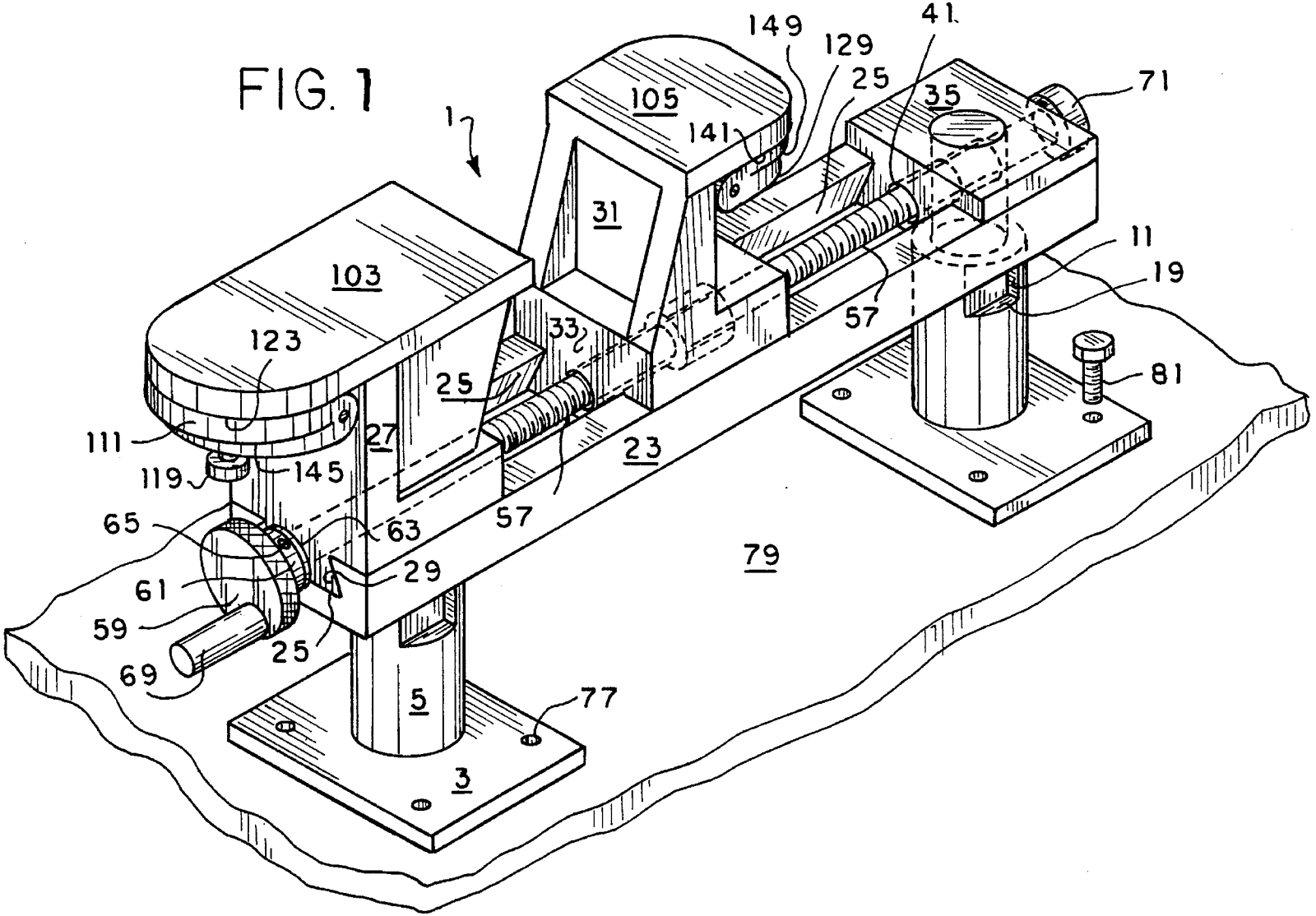
FIG. 1 is a perspective view of the device.
Figure 2:
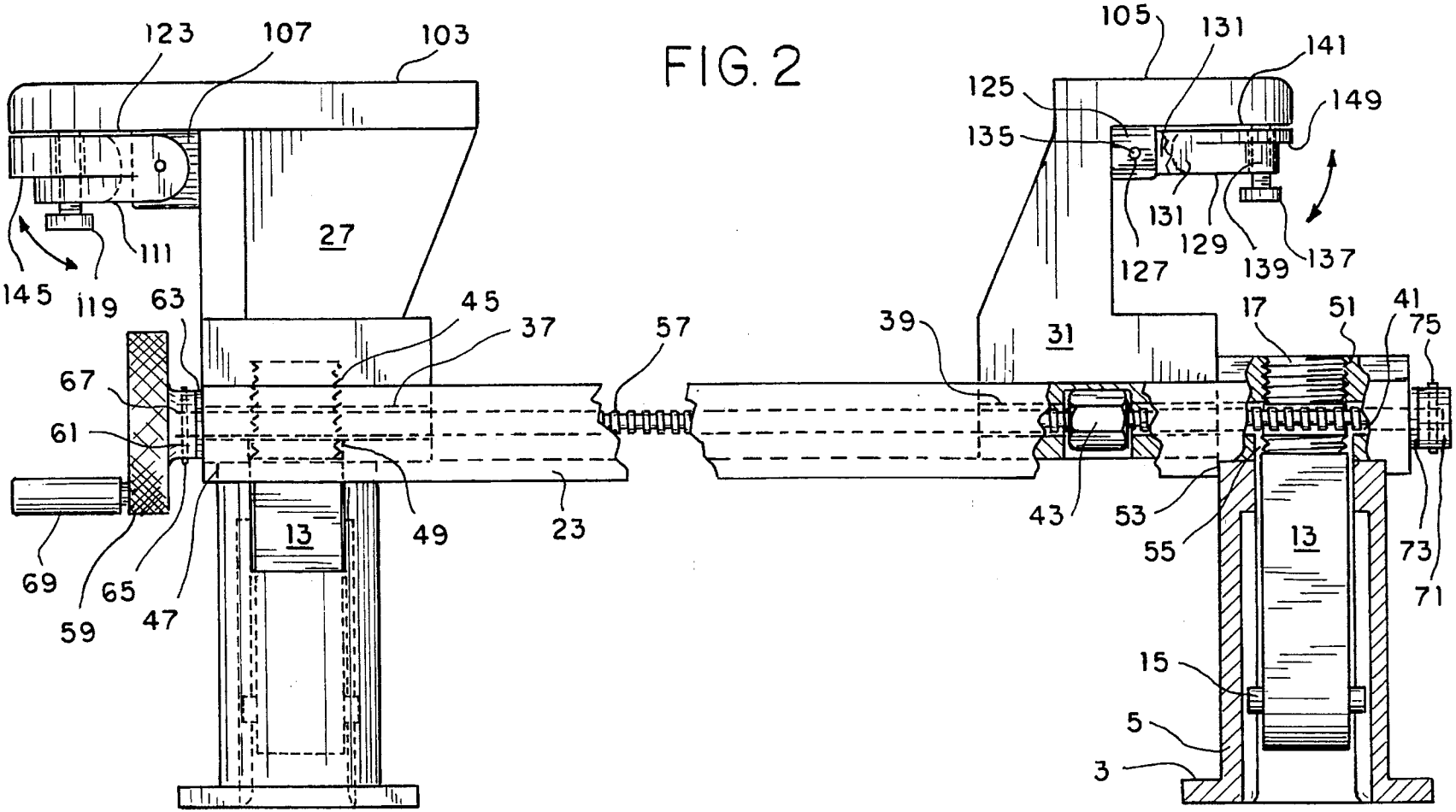
FIG. 2 is a elevational view of the device, partly broken-away and in section.
Figure 4:
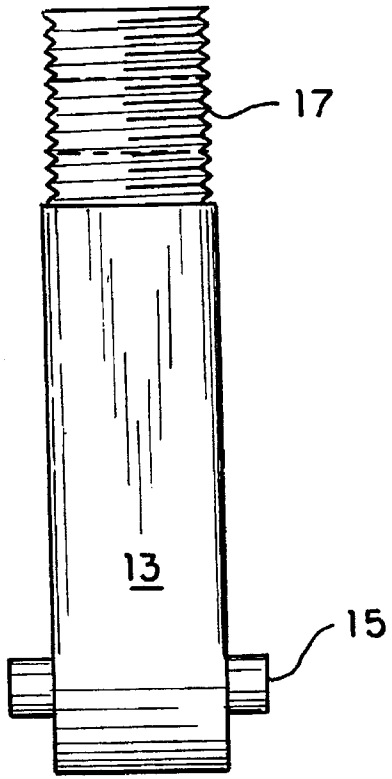
FIG. 4 is an elevational view of the attachment sliding member.

In FIG. 1 of the drawings, reference numeral 1 generally refers to the invention. Of integral, one-piece construction is a base 3 having vertically upstanding therefrom a tubular member 5 whose outer surface is round and whose open interior, cross-sectionally, is square defining inner-walled surfaces 7. Opposed and aligned vertical grooves 9, formed in two of the facing walled surfaces 7, extend from the bottom of the base 3 and extend upwardly in those two facing walled surfaces. An aligned, shouldered-out portion 11 is formed through each of the upper portions of the other two opposite facing walled surfaces. A cross-sectionally squared attachment sliding member 13, of integral, one-piece construction, complemental with the squared, inner-walled surfaces 7 of the tubular member 5, has two opposite aligned pivot pins or gudgeons 15 that transversely project from its bottom portion. The sliding member 13 is complementally received within the tubular member 5 with its pivot pins 15 likewise complementally engaging the aligned vertical grooves 9 in the tubular member 5. The top portion of the sliding member 13 is male-threaded, as indicated by reference numeral 17. The sliding member 13 can be reciprocated vertically within the tubular member 5; and, when the pivot pins 15 of the sliding member 13, complementally engaged with their respective grooves 9 of the tubular member 5, are vertically raised to their fullest extent, the sliding member 13 can be pivoted either 90 degrees in one direction with its own surface, in common with the bottom surface 19 of the tube's respective shouldered-out portion 11, abutting same with that bottom surface functioning as a limit stop; or the sliding member 13 can be pivoted 90 degrees in the opposite direction with its own surface, in common with the other bottom surface 19 of the tube's other respective shouldered-out portion 11, abutting same with that other bottom surface functioning as a limit stop. When the gudgeons 15, so engaged with the respective grooves in the tube 5, are vertically raised to their fullest extent preparatory to pivoting the sliding member 13 either 90 degrees in one direction or 90 degrees in the opposite direction, the interaction of the gudgeons 15 with their respective grooves 9 can be considered to be in a "trunnion-like" mode. The sliding-member's male-threaded top portion 17 has a transverse hole 21 therethrough.

The elongated bed 23 of the device 1 has a truncated-isosceles-triangularly removed portion defining a way 25. A fixed heel-carriage piece 27, of integral, one-piece construction, has a depending pillow-block portion 29 complementally engaging the way 25. A reciprocating toe-carriage piece 31, of integral one-piece construction, has a depending pillow-block portion 33 complementally engaging the way 25. A fixed, terminal pillow block 35 complementally engages the way 25. The pillow-block portions 29 and 33 and the pillow block 35 have respective longitudinally aligned transverse holes 37, 39 and 41 therethrough longitudinally aligned centrally relative to the bed 23. The depending pillow-block portion 33 of the toe-carriage piece 31 has a nut 43, fixedly embedded therein and aligned with the transverse hole 39, and hence, likewise longitudinally aligned with the respective transverse holes 37 and 41.

Figure 3:
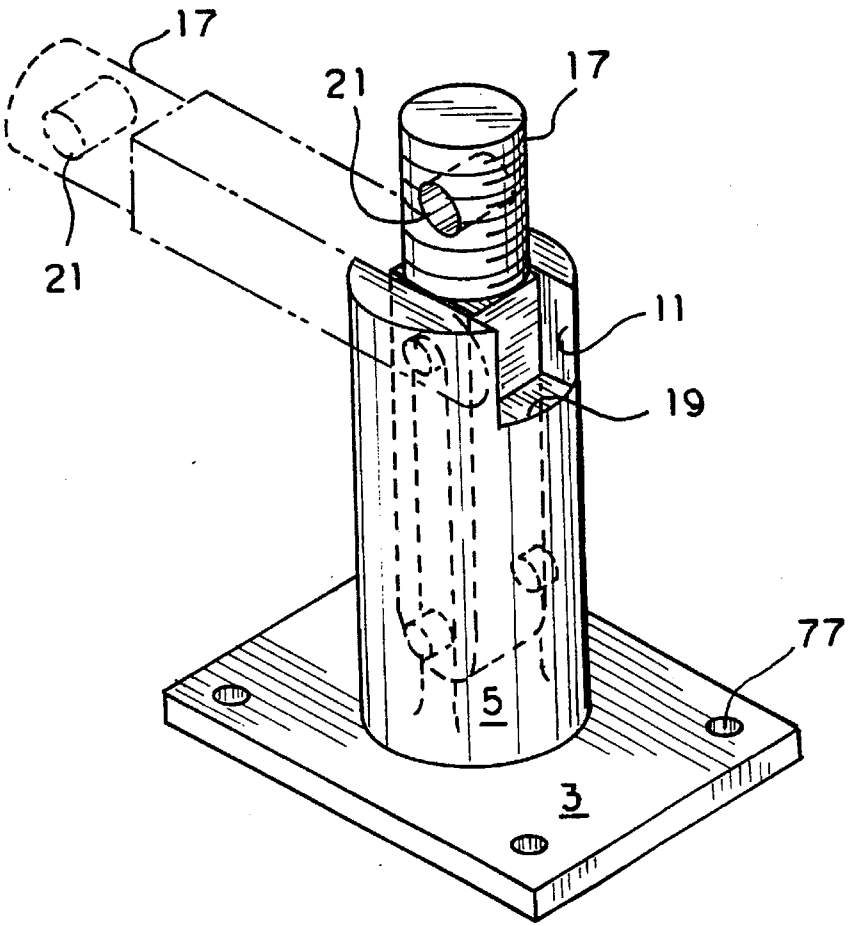
FIG. 3 is a perspective view of the attachment sliding member assembled with the combined tubular member and base.
Figure 6:
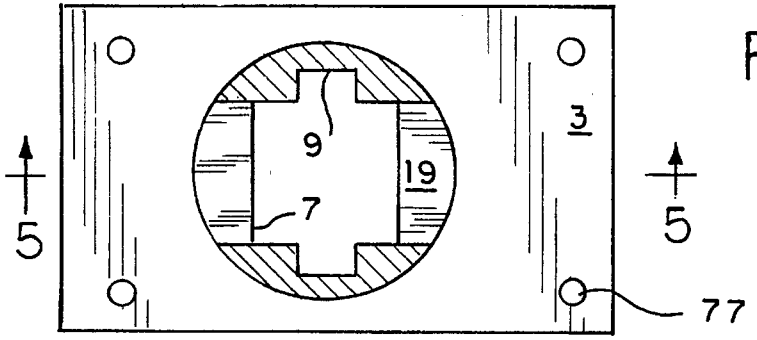
FIG. 6 is a sectional view taken in the direction of the arrows 6—6 in FIG. 5.
Figure 5:
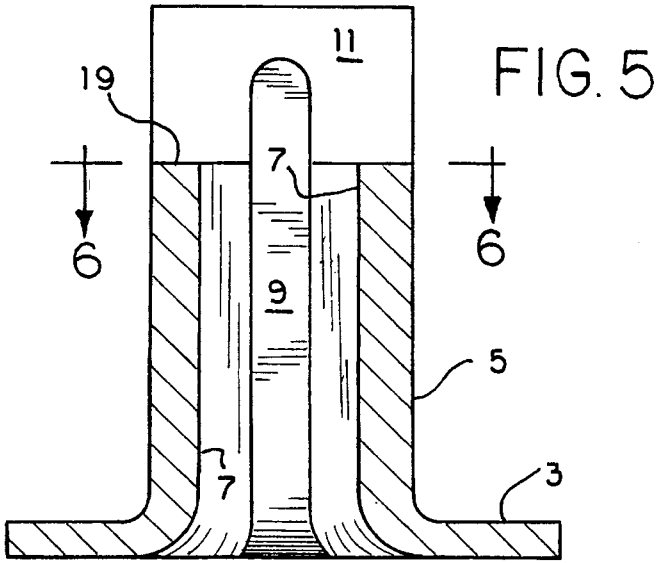
FIG. 5 is a sectional view of the base and tubular member.
Figure 7:
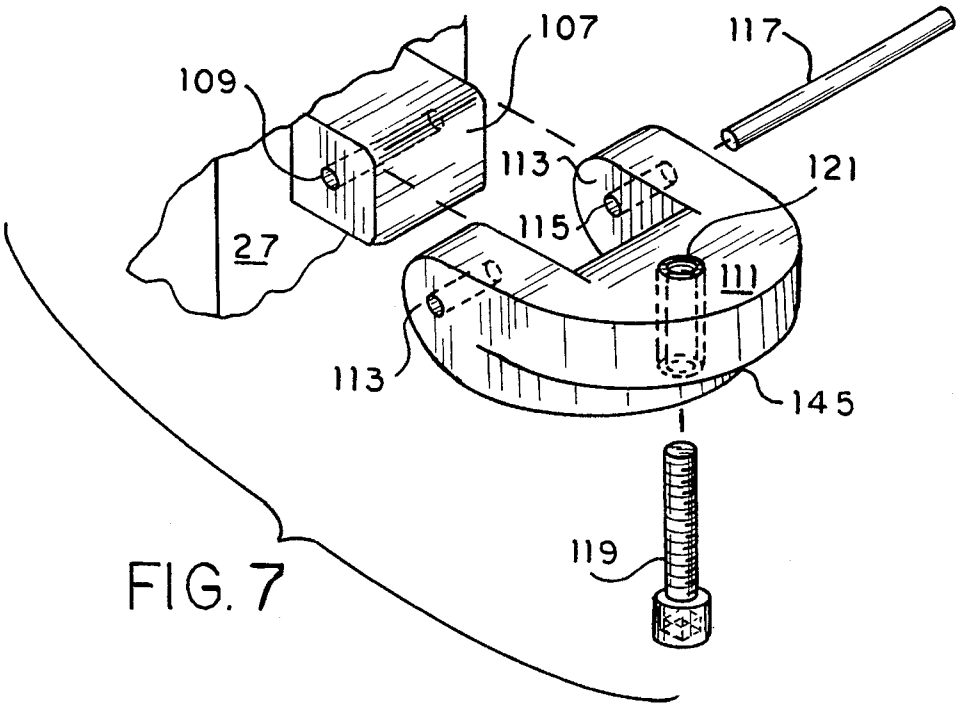
FIG. 7 is a fragmentary assembly view, in perspective, of the spatial accommodating element and the projecting tongue of the heel-carriage piece.

Concentric with a tapped hole 45 formed in the pillow-block portion 29 of the heel-carriage piece 27 are a counterbored hole 47 and a hole 49, formed in the way 25; and concentric with a tapped hole 51 formed in the pillow block 35 are a counterbored hole 53 and a hole 55, formed in the way 25. The internal diameters of the holes 49 and 55 are slightly larger than the male-threaded top portions 17 of the sliding members 13. The male-threaded top portion 17 of a sliding member 13 pre-assembled with its tubular member 5, as shown in FIG. 3, is appropriately inserted through the hole 49 in the way 25 and engaged with the tapped hole 45 in the pillow-block portion 29 of the heel-carriage piece 27 and tightened sufficiently such that the top end of the tubular member 5 complementally abuts within the counterbored hole 47 in the way 25 and such that the transverse hole 21 in the male-threaded top portion 17 of the sliding member 13 is longitudinally aligned with the transverse hole 37 in the pillow-block portion 29 of the heel-carriage piece 27. The male-threaded top portion 17 of another sliding member 13 pre-assembled with its tubular member 5, as shown in FIG. 3, is appropriately inserted through the hole 55 in the way 25 and engaged with the tapped hole 51 in the pillow block 35 and tightened sufficiently such that the top end of the tubular member 5 complementally abuts within the counterbored hole 53 in the way 25 and such that the transverse hole 21 in the male-threaded top portion 17 of the sliding member 13 is longitudinally aligned with the transverse hole 41 in the pillow block 35.

The internal diameter of each of the transverse holes 21, 37, 39 and 41 is the same and slightly larger than the external diameter of an elongated screw 57, such that the screw 57 may be appropriately disposed transversely to operatively engage the nut 43 with appropriate portions of the screw extending laterally and exteriorly of the pillow-block portion 29 and the pillow block 35. A hand wheel 59 having a flanged portion 61, appropriately diaposed on the one exterior portion of the screw 57, abuts an interposed thrust washer 63, with the flanged portion 61 being affixed to the screw 57 by a roll pin 65 disposed through a transverse hole 67 in the screw 57. The hand wheel 59 has a crank handle 69 projecting outwardly to facilitate turning of the screw 57. The other exterior portion of the screw 57 fixedly mounts a bearing end cap 71, abutting an interposed thrust washer 73, via a roll pin 75 disposed through a transverse hole (not shown but the same as transverse hole 67) in the screw 57. In one direction of rotation of the screw 57, the toe-carriage piece 31 will move longitudinally in a direction away from 6he heel-carriage piece 27; and in the opposite direction of rotation of the screw 57, the toe-carriage piece 31 will move longitudinally in the direction toward the heel-carriage piece 27.

Each of the bases 3 has holes 77 provided therethrough enabling fixed mounting of the device 1 to a support surface 79 by means of conventional bolts 81, disposed through the holes 77 aligned with pre-formed holes (not shown) in the support surface 79, and tightened by engaged nuts (not shown).

Figure 8:
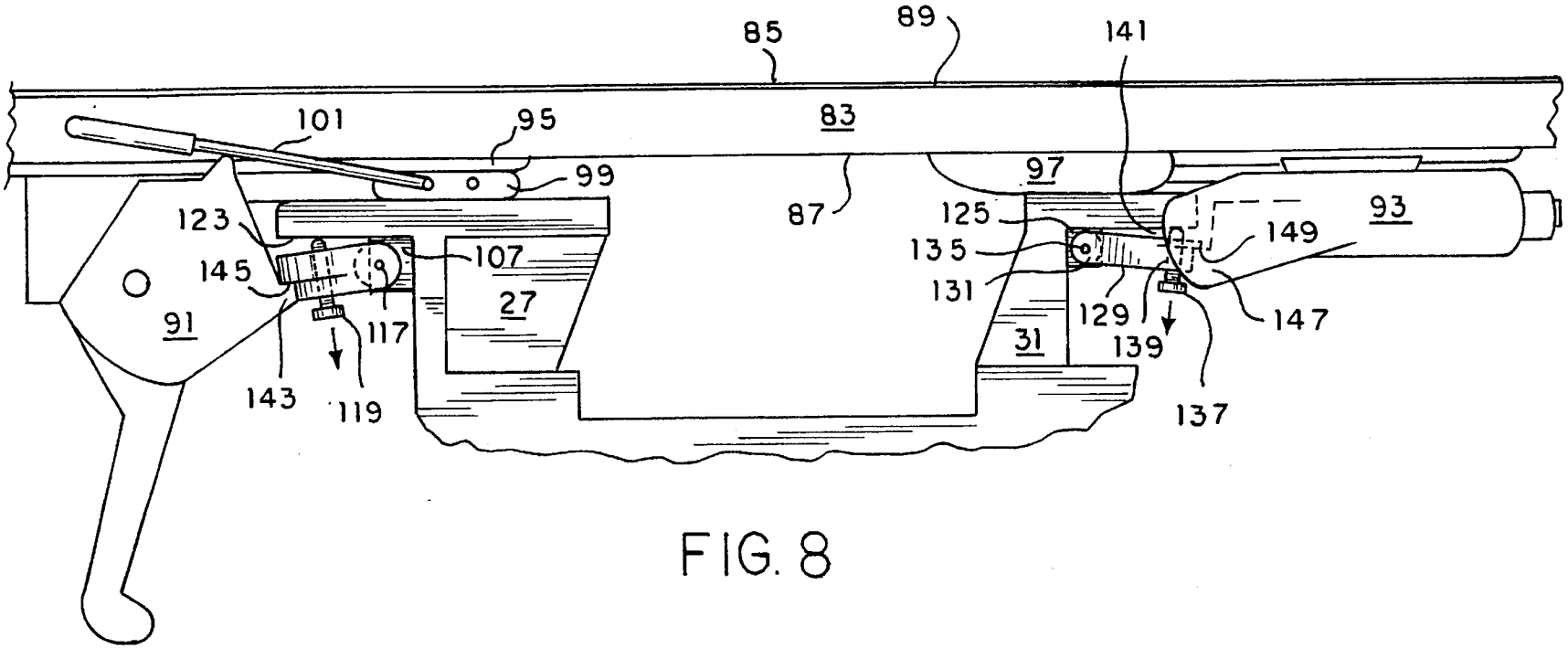
FIG. 8 is an elevational view of part of the device showing the device mounting a ski in its inverted position, preparatory to maintenance and tuning.

FIG. 8 shows the device 1 fixedly and positively mounting a conventional ski 83 in a fixed inverted position via the ski's binding preparatory to maintenance or tuning of the ski 83. The ski 83 has a major top surface 85, a major bottom surface or base 87, lateral steel edges 89 (only one edge of which is shown), and a conventional binding comprising a heel piece 91 and a toe piece 93. Also shown are boot pads 95 and 97, a brake retractor 99 and a brake arm 101.

The heel-carriage and toe-carriage pieces 27 and 31 have respective flat heel and flat toe parts 103 and 105, which together constitute a boot portion simulating a ski boot. Inasmuch as the flat toe part 105 of the toe-carriage piece 31 can be moved longitudinally either in one direction away from the flat heel part 103 of the fixed heel-carriage piece 27, or in an opposite direction toward the flat heel part 103, depending upon the direction of rotation of the hand wheel 59 and hence screw 57, the flat heel and toe parts 103 and 105 can thereby be longitudinally adjusted to simulate different sizes of ski boots and their corresponding bindings.

The heel-carriage piece 27 has a laterally projecting tongue 107 having a transverse hole 109 therethrough. A spatial accommodating element 111 has arms 113 each having a transverse hole 115 therethrough aligned with the transverse hole 109. A cross pin 117 appropriately disposed through the aligned holes 109 and 115 pivotably mounts the spatial accommodating element 111. A male-threaded screw 119, engaged with a tapped hole 121 formed in the spatial accommodating element 111 and bearing against an underside portion 123 of the flat heel part 103, provides adjustably pivotable disposition of the element 111. The toe-carriage piece 31 has a laterally projecting tongue 125 having a transverse hole 127 therethrough. A spatial accommodating element 129 has arms 131 each having a transverse hole 133 therethrough aligned with the transverse hole 127. A cross pin 135 appropriately disposed through the aligned holes 127 and 133 pivotably mounts the spatial accommodating element 129. A male-threaded screw 137, engaged with a tapped hole 139 formed in the spatial accommodating element 129 and bearing against an underside portion 141 of the flat toe part 105, provides adjustably pivotable disposition of the element 129. The binding's heel piece 91 has a catch 143 that engages a complemental shoulder 145 of the spatial accommodating element 111; and the binding's toe piece 93 has a catch 147 that engages a complemental shoulder 149 of the spatial accommodating element 129.

The described pivotable and adjustable features of the spatial accommodating elements 111 and 129, efectuated by rotating their respective screws 119 and 137 in one direction or the opposite direction, allow the respective elements 111 and 129 to spatially accommodate the vertical-height differences that present themselves in the various heel and toe pieces of conventional bindings.

Hence, in employing the device 1 to mount a ski in a positive and fixed inverted position via the heel piece and toe piece of its conventional binding, such positive and fixed inverted mounting of the ski is effectuated by longitudinal adjustment of the requisite longitudinal distance represented by the flat part 103 of the fixed heel-carriage piece 27 and the flat toe part 105 of the toe-carriage piece 31 to simulate the size of the ski boot, together with vertical height adjustments, as may be required for the heel piece and toe piece of such binding, by means of the spatial accommodating elements 111 and 129.

Accordingly, the device 1 provides the described "universal" structural adjustment features to spatially accommodate the differences in conventional ski bindings to allow the skis to be mounted in positive and fixed inverted positions.

With the exceptions of steel for the nut 43, the elongated screw 57, the hand wheel 59 its flanged portion 61 and crank handle 69, the thrust washer 63, the roll pin 65, the bearing end cap 71, the thrust washer 73, the roll pin 75, the bolts 81, the cross pin 117 and the screw 119, and the cross pin 135 and the screw 137, plastic is the material of choice for the device 1.

We claim:

1. A universal ski holding device for positive and fixed mounting of a conventional snow ski in an inverted position with its major bottom surface uppermost, preparatory to its maintenance and tuning, via its conventional binding, the ski having major top and bottom surfaces and lateral edges, and with the binding having a heel piece and a toe piece; the device comprising an elongated bed having a way, a fixed heel-carriage piece, a longitudinally movable toe-carriage piece, a fixed terminal pillow block, an elongated screw, and two mounting supports for the elongated bed; the heel-carriage piece having a depending pillow-block portion complementally engaging the way, the toe-carriage piece having a depending pillow-block portion freely and complementally engaging the way and being longitudinally movable therewith, the terminal pillow block complementally engaging the way, each mounting support having a combined base and vertically upstanding tubular member of integral, one-piece construction, each base being adapted for fixed mounting on a flat support surface, each base having squared, inner-walled surfaces with opposed and aligned vertical grooves in two of the facing walled surfaces, each mounting support having a cross-sectionally square sliding member whose exterior surfaces complementally engage the tubular-member's inner-walled surfaces, each sliding member having opposite aligned pivot pins complementally engaging the tubular-member's vertical grooves, each sliding member having a male-threaded top portion, the depending pillow-block portion of the heel-carriage piece having a tapped hole, the male-threaded top portion of the sliding member being fixedly engaged with the tapped hole in the depending pillow-block portion of the heel-carriage piece, the terminal pillow block having a tapped hole, the male-threaded top portion of the other sliding member being fixedly engaged with the tapped hole in the terminal pillow block, the depending pillow-block portion of the toe-carriage piece fixedly mounting a longitudinally aligned nut, the elongated screw being operatively engaged with the toe-carriage-piece's nut such that, in one direction of rotation of the elongated screw, the toe-carriage piece moves longitudinally in a direction away from the fixed heel-carriage piece, and, in the opposite direction of rotation of the elongated screw, the toe-carriage piece moves longitudinally in a direction toward the fixed heel-carriage piece, the heel-carriage and toe-carriage pieces constituting a boot portion simulating a ski boot, the heel-carriage and toe-carriage pieces each mounting, in adjustably pivotable relationship, a spatial accommodating element to spatially accommodate the vertical-height differences that present themselves in the various heel and toe pieces of conventional bindings.

2. A universal ski holding device in accordance with claim 1, wherein each tubular member has two aligned and opposite shouldered-out portions therethrough, each having a bottom surface such that, upon appropriately pivoting both sliding members 90 degrees in the same direction from their vertical positions, one exterior surface of each sliding member, complemental with and in common with the bottom surface of the shouldered-out portion of that tubular member will rest upon and abut that bottom surface to dispose an opposite lateral edge of the ski uppermost preparatory to its maintenance and tuning; and such that, upon appropriately pivoting both sliding members 90 degrees in the opposite direction from their vertical positions, one exterior surface of each sliding member, complemental with and in common with the bottom surface of the opposite shouldered-out portion of that tubular member will rest upon and abut that bottom surface to dispose the opposite lateral edge of the ski uppermost preparatory to its maintenance and tuning.

3. A universal ski holding device in accordance with claim 2, wherein the heel-carriage and toe-carriage pieces have respective flat heel and flat toe parts constituting the boot portion simulating the ski boot.

4. A universal ski holding device in accordance with claim 3, wherein the flat heel part has an underside portion and the flat toe part has an underside portion, wherein the heel-carriage's spatial accommodating element has a tapped hole engaged by a screw bearing against the flat-heel-part's underside portion for adjustably effectuating the requisite vertical height for the binding's heel piece, and wherein the toe-carriage's spatial accommodating element has a tapped hole engaged by a screw bearing against the flat-toe-part's underside portion for adjustably effectuating the requisite vertical height for the binding's toe piece.

5. A universal ski holding device in accordance with claim 4, wherein the heel-carriage piece has a laterally projecting tongue having a transverse hole therethrough and the heel-carriage-piece's spatial accommodating element has arms each having a transverse hole therethrough aligned with the transverse hole in the heel-carriage-piece's projecting tongue, and engaged with the aligned transverse holes in the heel-carriage-piece's tongue and the spatial-accommodating-element's arms, provides pivotable relationship therebetween; and wherein the toe-carriage piece has a laterally projecting tongue having a transverse hole therethrough and the toe-carriage-piece's spatial accommodating element has arms each having a transverse hole therethrough aligned with the transverse hole in the toe-carriage-piece's projecting tongue, and engaged with the aligned transverse holes in the toe-carriage-piece's tongue and spatial-accommodating-element's arms, provides pivotable relationship therebetween.

6. A universal ski holding device in accordance with claim 5, wherein the heel-carriage-piece's depending pillow-block portion, the toe-carriage-piece's depending pillow-block portion and the pillow block have longitudinally aligned transverse holes therethrough whose internal diameters are slightly larger than the elongated-screw's external diameter, the male-threaded top portions of the sliding members have longitudinally aligned transverse holes therethrough whose internal diameters are slightly larger than the elongated-screw's external diameter and are aligned with the transverse holes in the heel-carriage-piece's depending pillow-block portion, the toe-carriage-piece's depending pillow-block portion and the pillow block to allow the elongated screw to be freely disposed through all those transverse holes and to be operatively engaged with the longitudinally aligned nut fixedly carried by the depending pillow-block portion of the toe-carriage piece.

7. A universal ski holding device in accordance with claim 6, wherein the elongated screw fixedly carries a hand wheel to facilitate manipulative rotation of the elongated screw.

* * * * *